US007970339B2

(12) United States Patent
Hata

(10) Patent No.: US 7,970,339 B2
(45) Date of Patent: Jun. 28, 2011

(54) SHEET FEEDING DEVICE AND IMAGE FORMING APPARATUS

(75) Inventor: Kiyoshi Hata, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 850 days.

(21) Appl. No.: 11/656,952

(22) Filed: Jan. 24, 2007

(65) Prior Publication Data

US 2008/0067731 A1 Mar. 20, 2008

(30) Foreign Application Priority Data

Aug. 22, 2006 (JP) ..... 2006-225100

(51) Int. Cl.
*G03G 15/00* (2006.01)
*B42C 11/00* (2006.01)

(52) U.S. Cl. ..... 399/408; 412/4

(58) Field of Classification Search ..... 412/4, 5, 412/22; 399/408
See application file for complete search history.

(56) References Cited

U.S. PATENT DOCUMENTS 5,609,333 A * 3/1997 Mandel et al. ..... 270/58.09
5,735,515 A * 4/1998 Hayashi et al. ..... 270/58.11

FOREIGN PATENT DOCUMENTS

JP 09207245 A * 8/1997
JP 10-181237 7/1998
JP 10181237 A * 7/1998
JP 2004-209859 7/2004
JP 2004-209870 7/2004
JP 2004209870 A * 7/2004

OTHER PUBLICATIONS

Japanese Office Action dated Sep. 9, 2008.

* cited by examiner

*Primary Examiner* — Ren Yan
*Assistant Examiner* — Allister Primo
(74) *Attorney, Agent, or Firm* — Finnegan, Henderson, Farabow, Garrett & Dunner, L.L.P.

(57) ABSTRACT

A bookbinding apparatus, having a sheet bundle storing device to store a sheet bundle, a grasping device to grasp the sheet bundle stored in the sheet bundle storing device, a square spine forming device to form a square spine, wherein a pair of forming members bend a coversheet bonded onto a back section of the sheet bundle grasped by the grasping device, a pressure force controlling device to vary a pressure force of the pair of forming members to press a bending section of the coversheet in accordance with bookbinding conditions.

14 Claims, 10 Drawing Sheets

SHEET FEEDING DEVICE AND IMAGE FORMING APPARATUS

This application is based on Japanese Patent Application No. 2006-225100 filed on Aug. 22, 2006, in Japanese Patent Office, the entire content of which is hereby incorporated by reference.

BACKGROUND OF THE INVENTION

The present invention relates to a bookbinding machine which accumulates a sheet to make a sheet bundle and bonds a coversheet on the sheet bundle to form a square spine, and an image forming system having the bookbinding machine and an image forming apparatus main body.

For example, an image forming apparatus with electrophotographic method having high speed performance, a multi function and a network function is expanding its application as a printing apparatus by connecting with a large capacity sheet feeding apparatus and a large capacity stacker.

In case the image forming apparatus is used as a printing machine, one system can perform a job from printing to binding in a sequence of flow by connecting the bookbinding machine to bind prints.

In a bookbinding machine of Patent Document 1, a sheet on which an image is formed in an image forming apparatus is accumulated in a sheet accumulation section having an oblique sheet accumulation area to be shaped into a sheet bundle which configures a booklet, and the sheet bundle is conveyed to a jointing process section. Thereafter the sheet bundle is turned to be in vertical condition, and then application of an adhesive and jointing of coversheet are carried out for the sheet bundle in a vertical condition so as to form a book.

Also, as a bookbinding process it has been known that a sheet bundle in which printed sheets are accumulated is covered by a coversheet in U-shape to form a booklet.

Patent Document 1: Non-examined Patent Publication No. 2004-209869

In the bookbinding machine disclosed in Patent Document 1, a constant prescribed pressure is always applied onto the coversheet for pressing and forming each square spine, irrespective of changes of a thickness of the sheet bundle to be bound, and number and a basis weight of the sheet, as well as changes of size of the sheet for the booklet bound and a basis weight of the coversheet.

However, when the square spine is formed, if the pressure of a forming member is excessive, an amount of adhesive agent to run over increases and appearant quality of the square spine is deteriorated. Also, if the pressure of forming member is excessively low, the spine cannot be formed square enough, with the result that the appearance quality is deteriorated and strength of the booklet decreases.

SUMMARY

The present invention is as follows.

(1) A bookbinding apparatus, having: a sheet bundle storing device to store a sheet bundle, a grasping device to grasp the sheet bundle stored in the sheet bundle storing device, a square spine forming device to form a square spine, wherein a pair of forming members bend a coversheet bonded onto a back section of the sheet bundle grasped by the grasping device, a pressure force controlling device to vary a pressure force of the pair of forming members to press a bending section of the coversheet in accordance with bookbinding conditions.

(2) An image forming system, having; an image forming apparatus to form an image on a recording sheet based on data of a manuscript, and the bookbinding apparatus of (1).

BRIEF DESCRIPTION OF THE DRAWINGS

FIG. 7 (*b*) is a cross-sectional view of a square spine forming device and a sheet bundle showing a folding process of the coversheet where the cover sheet is bent.

FIG. 7 (*c*) is a cross-sectional view of a square spine forming device and a sheet bundle showing a folding process of the coversheet where the spine is pressed.

FIG. 7 (*d*) is a cross-sectional view of a square spine forming device and a sheet bundle showing a folding a process of the coversheet where pressure is released.

FIG. 8 (*b*) is perspective view showing a process of making a booklet by sheet bundle and a coversheet where coversheet K is in contact with the back of the sheet bundle.

FIG. 8 (*c*) is perspective view showing a process of making a booklet by sheet bundle and a coversheet where the spine is being formed.

FIG. 10(*b*) is a cross-sectional view of sheet storing device 40 with a detecting device for a sheet thickness showing a status before applying the adhesive agent where retaining plate 42 is retracted.

DETAILED DESCRIPTION OF THE PREFERRED EMBODIMENT

An embodiment of a bookbinding machine of the present invention and an image forming apparatus having the bookbinding machine thereof are explained with reference to figures, without the present invention being restricted thereto.

Figure 1:
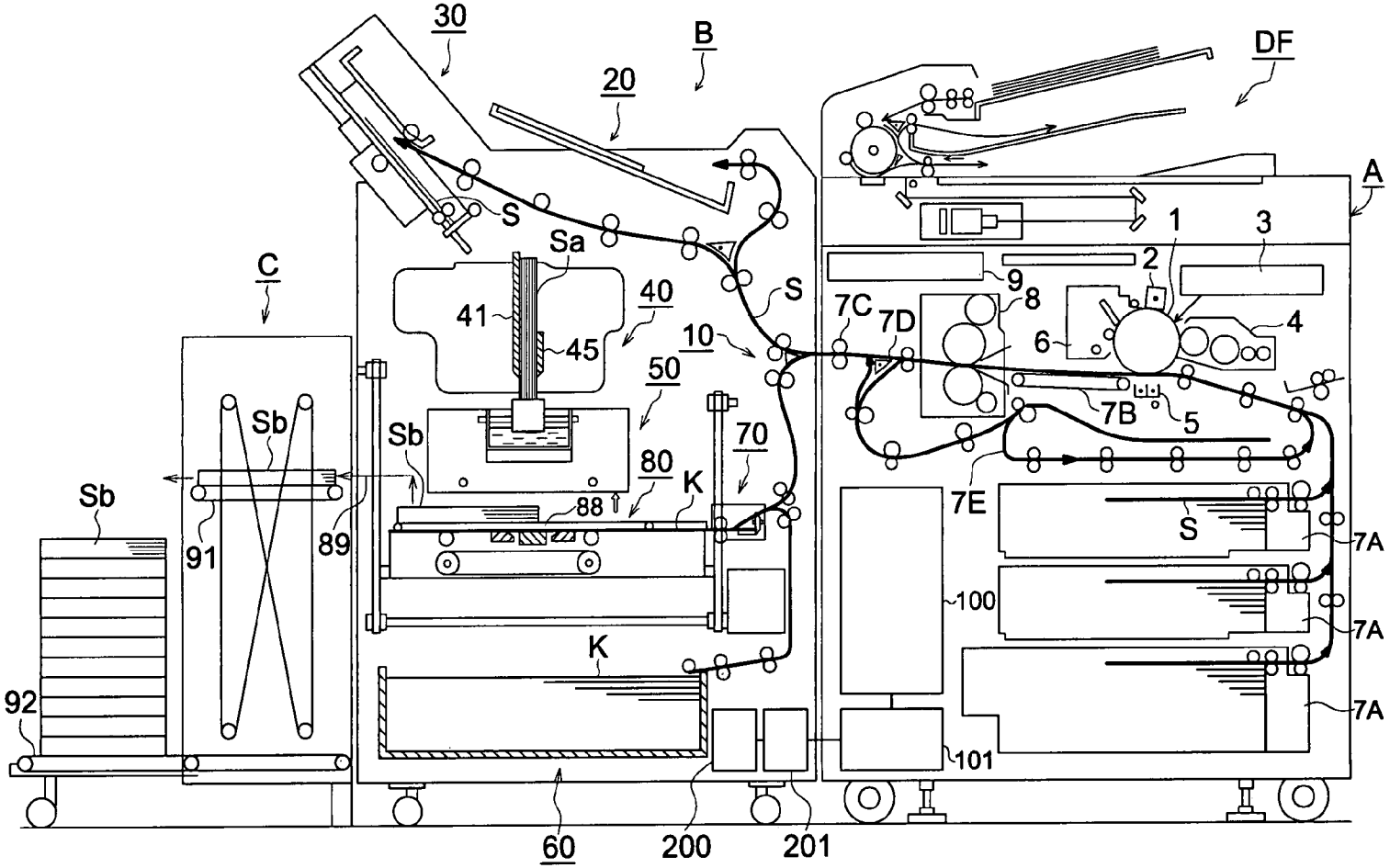
FIG. 1 is a total structural view of an image forming apparatus having an image forming apparatus main body, a bookbinding apparatus and a booklet storing device.

FIG. 1 is a view of total structure of bookbinding system having image forming apparatus main body A, bookbinding apparatus (post-processing apparatus) B, booklet storing apparatus C and automatic document conveyance apparatus DF.

<Image Forming Apparatus Main Body A>

Image forming apparatus main body A has charging device 2, image exposing device 3, developing device 4, transferring discharging device 5 and cleaning device 6 in an peripheral area of rotating image carrier 1. An image forming device charges an surface of image carrier 1 evenly through charging device 2, and thereafter forms an latent image by exposition scanning based on image data read from an manuscript through a laser beam of image exposing device 3, and then forms a toner image on an surface of image carrier 1 by developing the latent image by reversal development through developing device 4.

A recording sheet (hereinafter called sheet), which is fed from sheet storing device 7A, is conveyed to a transferring position. After transferring the toner image onto sheet S through transferring discharging device 5 in the transferring position, sheet S is discharged to be separated from image carrier 1 and conveyed through conveyance device 7B, then subsequently fixed by heat through fixing device 8 then ejected from ejection roller 7C.

In case the images are formed on both sides of surfaces of sheet S, sheet S fixed by heat through fixing device 8 is diverged from an ordinary ejection pass through conveyance pass switching device 7D and is reversed by switching back in reversal conveyance device 7E, then again passes through the image forming section to form the image on an reverse side of sheet S, and then passes through fixing device 8 to be ejected from ejection roller 7C to outside the apparatus. Sheet S ejected from ejection roller 7C is fed to bookbinding apparatus B.

The surface of image carrier 1 after image processing is cleaned by cleaning device 6 for removing remaining developing agent on the surface to be ready for next image processing.

Above image forming apparatus main body A, operation device 9 having an inputting device and a display device is provided.

<Bookbinding Apparatus B>

As FIG. 1 shows, bookbinding apparatus B is a case-in bookbinding apparatus having sheet conveyance device 10, sheet ejection device 20, sheet reversal device 30, sheet bundle storing device 40, adhesive agent application device 50, coversheet supplying device 60, coversheet cutting device 70 and square spine forming device 80. Each of these devices is arranged in a cascade approximately vertically in bookbinding apparatus B.

Meanwhile, apart from the case-in bookbinding device, a post-process apparatus of the present invention is capable of a flat binding device, a middle folding middle binding device and a cast sealing device.

Main control device 100 of image forming apparatus main body A and post-processing control device 200 of bookbinding apparatus B are connected through serial communication devices 101 and 102.

Figure 2:
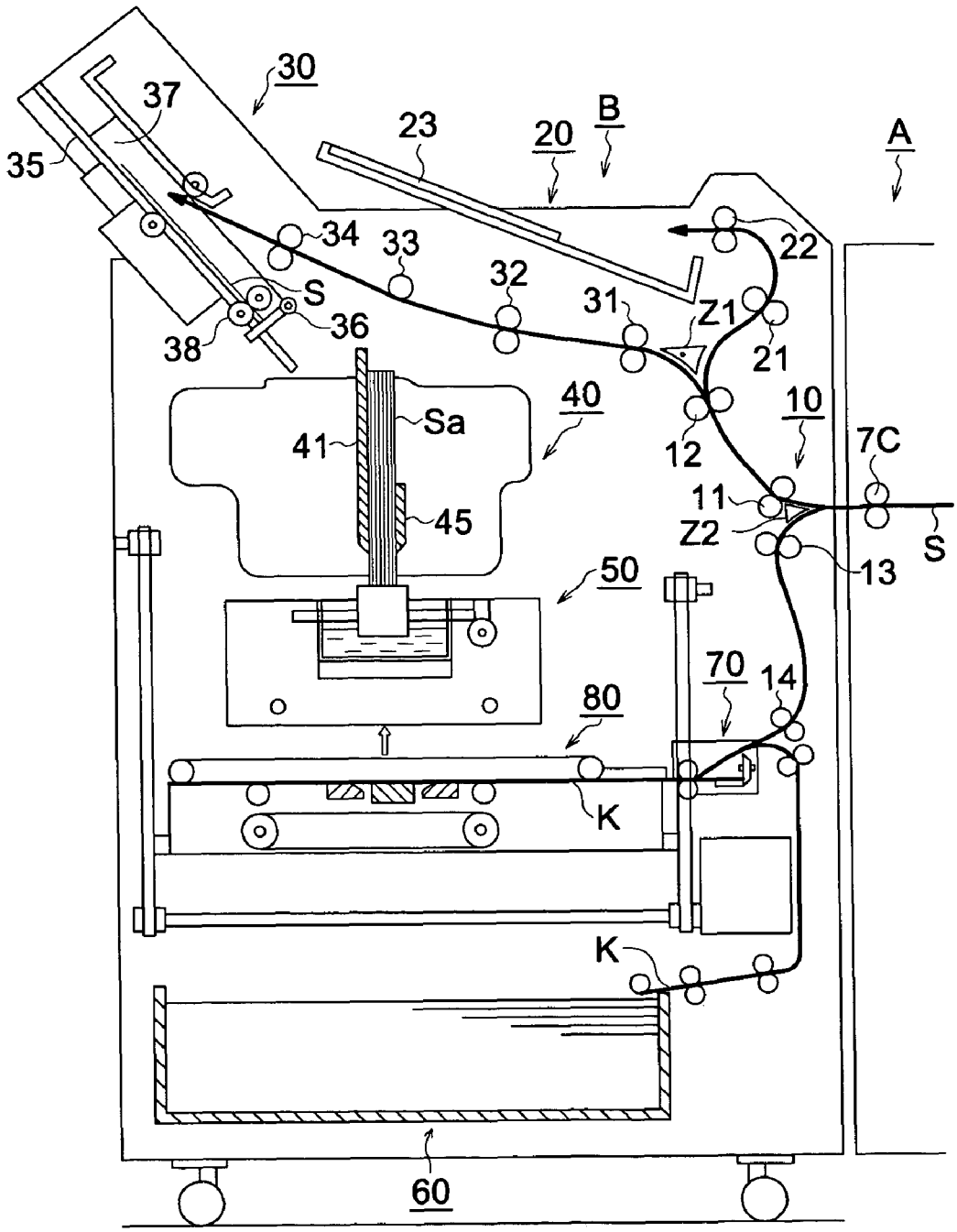
FIG. 2 is a cross-sectional view of a bookbinding apparatus related to the present invention.

FIG. 2 is a cross-sectional view of bookbinding apparatus B related to the present invention.

<Sheet Conveyance Device 10>

Sheet S introduced into sheet conveyance device 10 is grasped by conveyance rollers 11 and 12 and conveyed and then sheet S is diverged to either sheet ejection device 20 or sheet reversal device 30 through conveyance pass switching device Z1.

Conveyance pass switching device Z2 disposed on upstream side of conveyance roller 11 in a sheet conveyance direction diverges sheet S ejected from image forming apparatus main body to either a conveyance pass of conveyance roller 11 or a conveyance pass of conveyance roller 13. Sheet S conveyed to the conveyance pass of conveyance roller 13 is grasped to be conveyed to square spine forming device 80.

<Sheet Ejecting Device 20>

When this sheet conveyance is selected, conveyance pass switching device Z1 shuts off a conveyance pass to sheet bundle storing device 40 and open a conveyance pass to sheet ejection device 20.

Sheet S, which passes through the conveyance pass of ejection device 20 is grasped by conveyance roller 21 to be conveyed to upward, and ejected to be stored on fixed sheet ejection tray 23 locating on the uppermost part of the apparatus. Fixed sheet ejection tray 23 can receive sheet S ejected from image forming apparatus main body. A directly and load approximately up to 200 pieces of sheet S.

<Sheet Reversal Device 30>

Sheet S diverged by conveyance pass switching device Z1 leftward in a downstream side of a sheet conveyance direction shown by the figure is pinched by conveyance rollers 31, 32, 33 and 34 and stored in a predetermined position of sheet reversal device 30. Sheet reversal device 30 has sheet placing table 35 disposed obliquely, sheet rear end positioning member 36 which can swing, sheet width aligning member 37 and conveyance roller 38.

<Sheet Bundle Storing Device 40>

Figure 3:
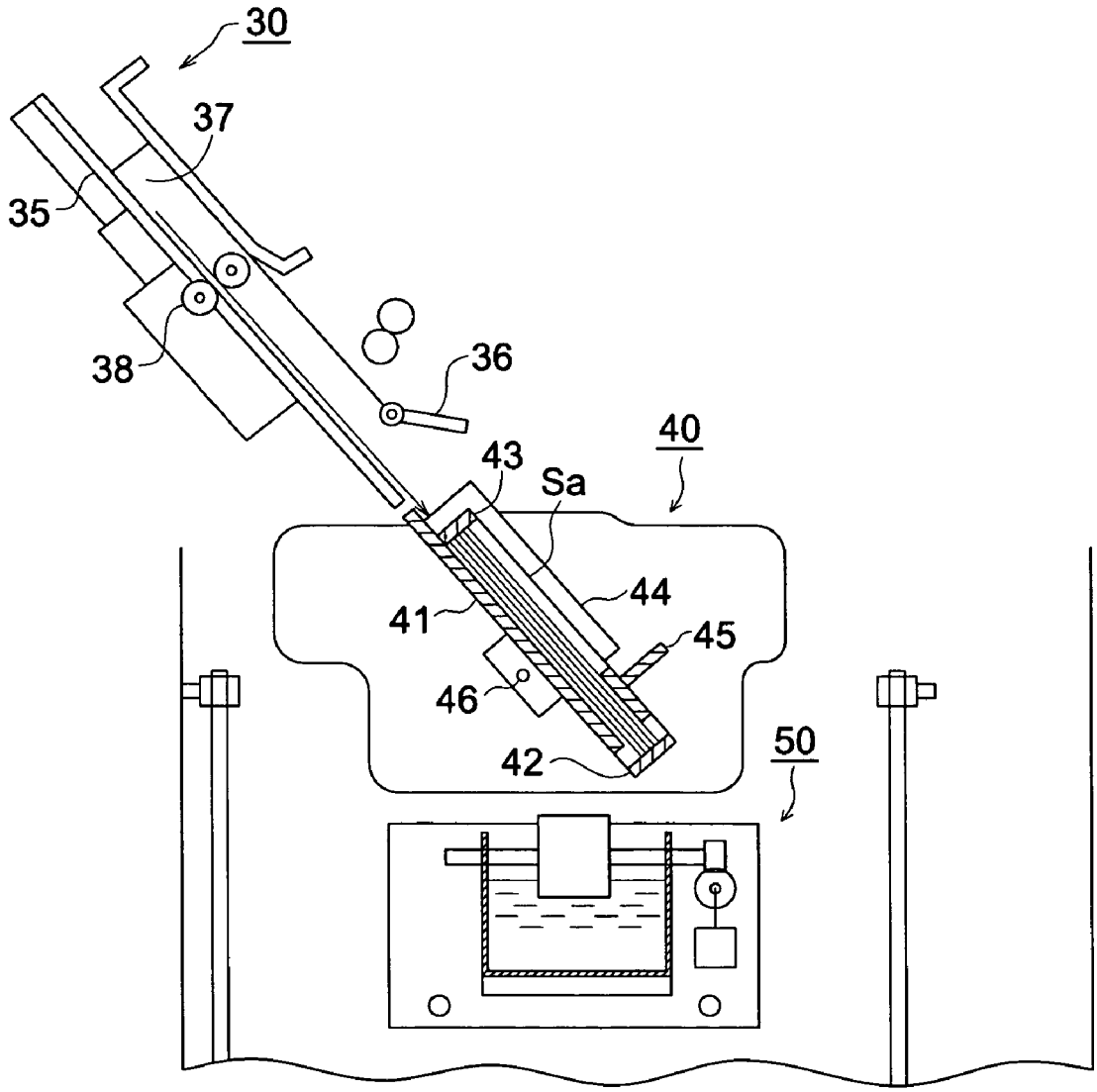
FIG. 3 is a cross-sectional view where a sheet accumulation device of a sheet bundle storing device is arranged in an oblique condition.

FIG. 3 is a cross-sectional view of sheet bundle storing device 40 where a sheet accumulation device is arranged in an obliquely status.

The sheet accumulation device has supporting member 41, receiving plate 42, rear end aligning member 43 and lateral aligning member 44 and pressing member 45.

Sheet S placed on sheet placing table 35 of sheet reversal device 30 is grasped by conveyance roller 38 to be ejected from an opening opened by swing of sheet rear end positioning member 36 and conveyed downward diagonally.

Sheet bundle storing device 40 has supporting member 41 having oblique accumulation area 41 and receiving plate 42 which can swing, wherein sheet S coming down form sheet reversal device 30 slips and drops on the accumulation area of oblique supporting member 41, and stops by receiving plate 42 to which the front edge of the sheet S comes in contact, then sheet S is supported in a oblique condition.

According to the size of sheet S placed on the accumulation surface of supporting member 41, rear end aligning member 43 presses the rear end section of sheet S to bring the front end of the sheet S into contact with receiving plate 42 so that the front ends are aligned (longitudinal alignment).

Sheet S successively ejected from image forming apparatus main body A is conveyed and switchbacks in sheet reversal device 30 and accumulated in sheet bundle storing device 40, then sheet S is longitudinally aligned and laterally aligned (explained later) to form sheet bundle Sa composed of a plurality of sheets S.

Size and number of sheet S are assigned in operation device 9 in image forming apparatus main body A shown in FIG. 1. Also, an external device such as a personal computer connected to image forming apparatus main body A assigns the size and the number thereof.

Lateral aligning member 44 performs alignment in a width direction by pressing the side edge of sheet S conveyed from sheet reversal device 30 and stored in sheet bundle storing device 40, while on line system is in operation i.e. bookbinding apparatus is associated with image forming apparatus main body A.

Also, while off-line system is in operation, i.e. only bookbinding process is carried out without associating with image forming apparatus main body A, the sheet bundle Sa from outside stored in sheet bundle storing device 40 is manually aligned in the lateral direction by gripping lateral aligning member 44.

Pressing member 45 grasps sheet bundle Sa accumulated in sheet bundle storing device 40 by pressing it in a thickness direction. In a stage where a predetermined number of sheet S are stored in sheet bundle storing device 40, pressing member 45 is operated by an unillustrated driving device so that a grasping device composed of supporting member 44 and pressing member 45 to grasp and hold sheet bundle Sa.

Figure 4:
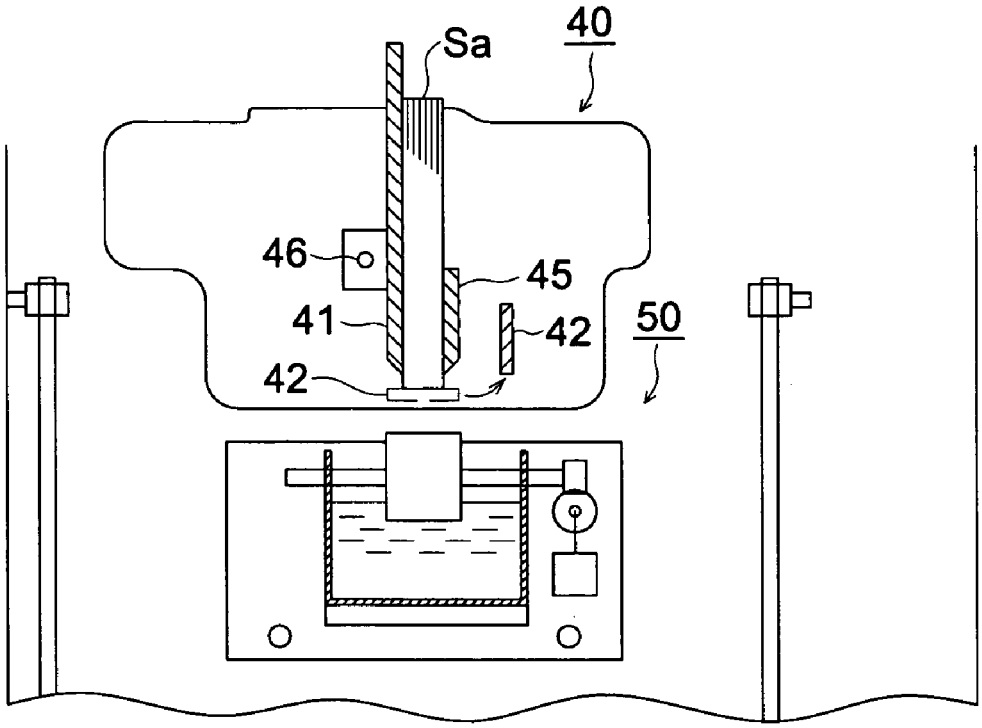
FIG. 4 is a cross-sectional view where a sheet accumulation device of the sheet bundle storing device is arranged in a vertical condition.

FIG. 4 is a cross-sectional view of the sheet accumulation device of sheet bundle storing device 40 in which the sheet accumulation device is arranged in a vertical status.

Supporting member 41 holding sheet bundle Sa and pressing member 45 can rotate centering on axis 46 of sheet bundle storing device 40 through an unillustrated motor and a diving device so that sheet bundle Sa becomes the vertical status from the oblique status. In this status, adhesive agent applying device 50 is retracted downward and a bottom surface of sheet bundle Sa is detached from adhesive agent applying roller 51 of adhesive agent applying device 50.

Also, in a status where supporting member 41 and pressing member 45 hold sheet bundle Sa, receiving plate 42 is rotated and retracted from a position of broken lines to a position of a solid line shown by the figure through an unillustrated driving device.

<Adhesive Agent Applying Device 50>

Figure 5:
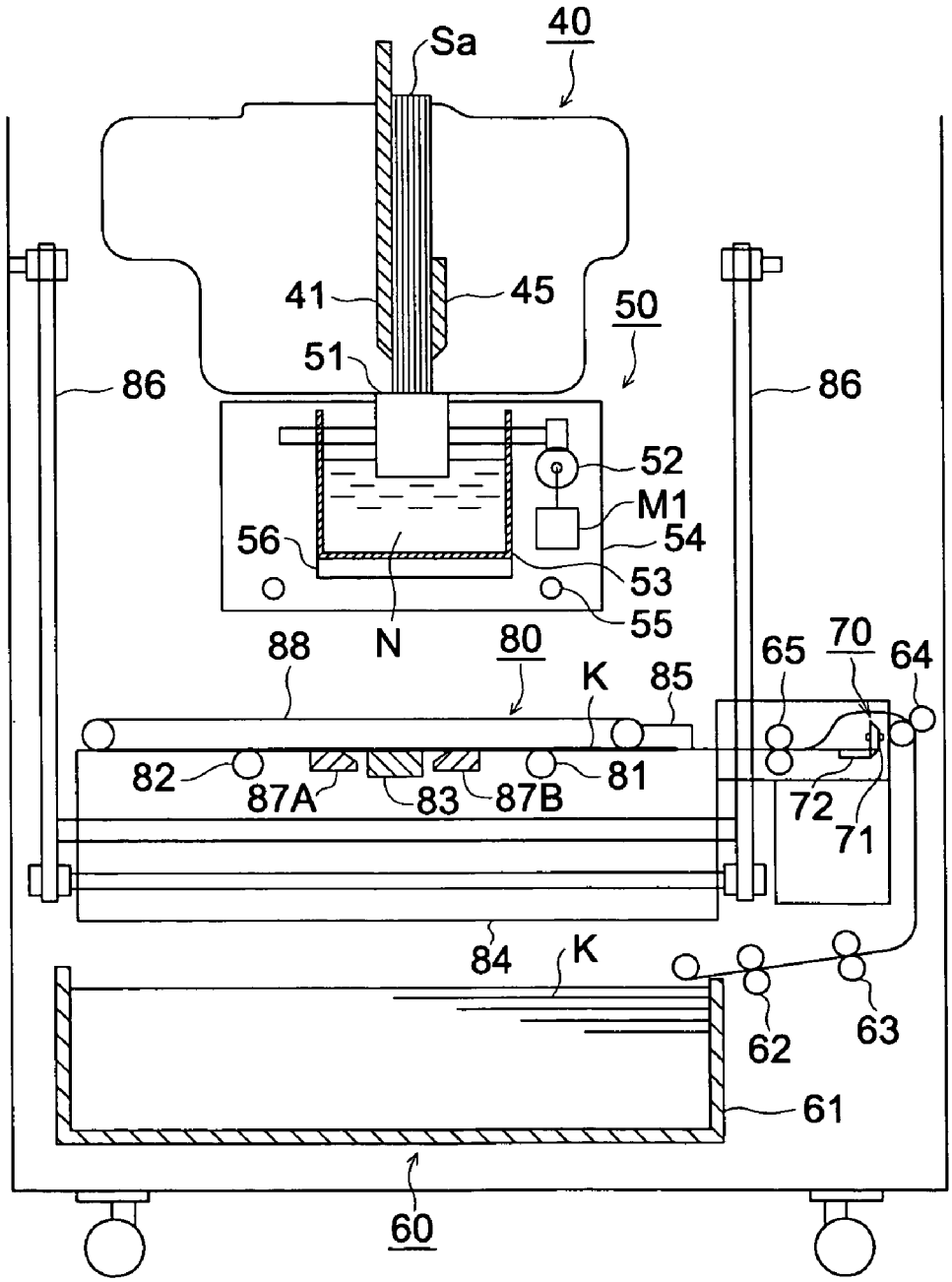
FIG. 5 is a cross-sectional view of the sheet bundle storing device, an adhesive agent applying device, a coversheet supplying device, a coversheet cutting device and a square spine forming device.

FIG. 5 is a cross-sectional view of sheet bundle storing device 40, adhesive agent applying device 50, coversheet supplying device 60, coversheet cutting device 70 and square spine forming device 80.

Adhesive agent applying device 50 has adhesive agent applying roller 51, driving device 52 to rotate adhesive applying roller 51, adhesive agent container 53 to contain adhesive agent (glue) N, moving body 54 capable of moving from an initial position in back side R of bookbinding apparatus B to an adhesive agent applying position of front side F while supporting adhesive agent container 53, moving device 55 to reciprocate moving body 54, and heating device 56 to heat adhesive agent N contained in adhesive agent container 53.

<Applying the Adhesive Agent to the Sheet Bundle>

Moving body 54 of adhesive agent applying device 50 is moved through an unillustrated driving device in a direction parallel to a longitudinal direction of the bottom surface of sheet bundle Sa which is held in vertical status by a grasping device composed of supporting member 41 and pressing member 45.

Moving body 54 starts to move from an initial position of back side R of bookbinding apparatus B and moves along moving device 55, then stops at a predetermined position of front side F of bookbinding apparatus B. Thereafter moving body 54 returns to the initial position by reverse drive.

Figure 6:
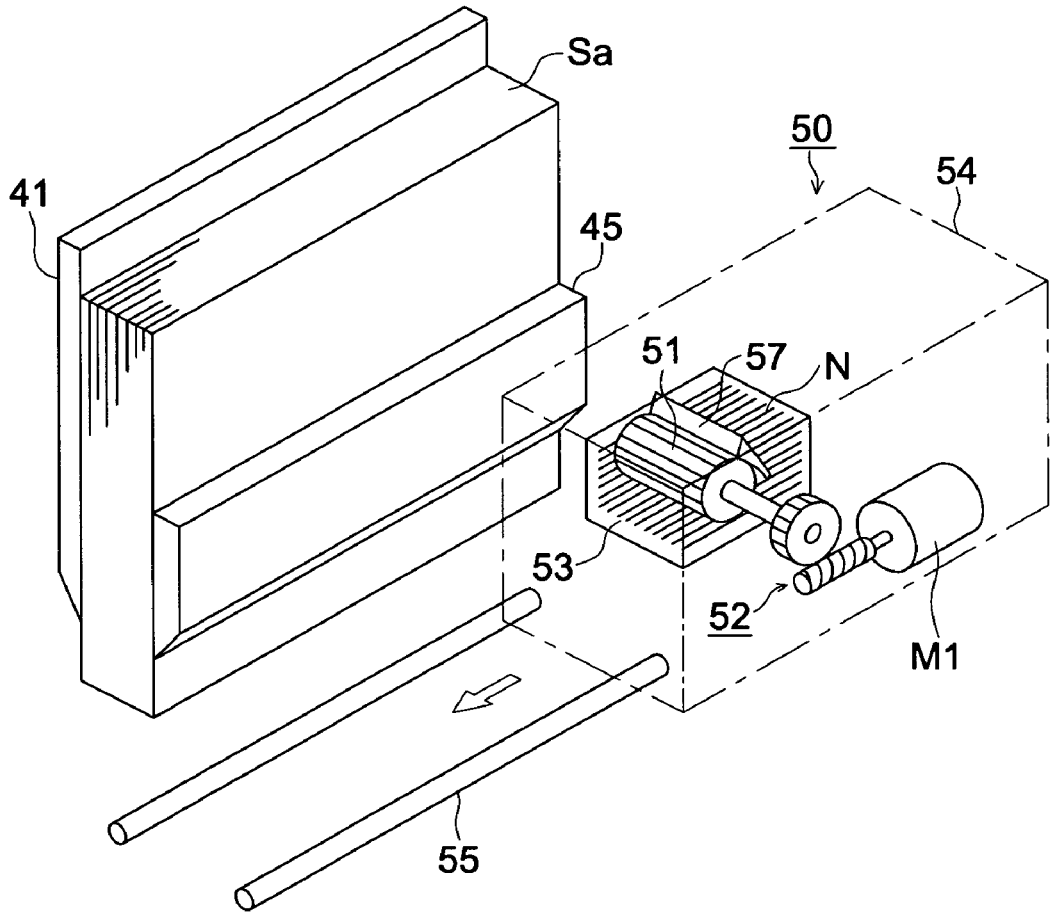
FIG. 6 is a perspective view of an adhesive agent applying device and a grasping device.

FIG. 6 is a perspective view of adhesive agent applying device 50 and the grasping device.

Adhesive agent applying roller 51 immersed in adhesive agent N contained in adhesive agent container 53 is rotated through motor M1 and driving device 52. In forward stroke or reciprocation of moving body 54, adhesive agent applying roller 51 applies adhesive agent N in the longitudinal direction on the bottom surface of sheet bundle Sa held in the vertical position.

Adhesive agent N applied on an outer circumferential surface of rotating adhesive applying roller 51 is regulated in thickness of layer of adhesive agent N by adhesive agent layer thickness regulation member 57 so that the layer thickness of adhesive agent N becomes even.

<Coversheet Supplying Device 60>

A sheet K for a cover (hereinafter called coversheet) which is stored in coversheet loading device 61 of coversheet supplying device 60 is separated and fed by sheet feeding device 62 and grasped by conveyance rollers 63, 64 and 65 to be conveyed to square spine forming device 80.

<Coversheet Cutting Device 70>

In the figure, above coversheet supplying device 60, coversheet cutting device 70 integrally configured with square spine forming device 80 to be described on the right in the figure, cuts coversheet K by a predetermined length in a conveyance direction with a rotary cutter composed of a rotation blade and a fixed blade.

The predetermined length is a length which is a length of two sheets S in the conveyance direction and a length of the spine. For example, in case of a case-in bookbinding where coversheet K is glued on the spine of sheet bundle Sa composed of A4 size sheet S, if a maximum sheet number and a thickness of sheet bundle Sa is 300 pieces and 30 mm respectively, the predetermined length is set at 450 mm which is two times of 210 mm of a length of short side of A4 sheet and approximately 30 mm of the thickness of the sheet bundle Sa, to cut an edge of coversheet K. A wide size coversheet K which is more than 450 mm in a total length before cutting is used.

In case the sheets S of A5 size, B5 size and 5.8×11 inch (1 inch is 25.4 mm) size are used for cast-in bookbinding process to from booklet Sb, the predetermined length is set based on the length of the short side of the sheet and the thickness of the sheet bundle.

When the sheet size, the sheet number and sheet thickness are selected and set or detected through operation device 9 of image forming apparatus main body A, or external devices connected with the image forming apparatus main body A, a control device assigns the predetermined cutting length of coversheet K. The length of coversheet K before cutting is predetermined according to the maximum number of the sheet and coversheet K is stored in coversheet loading device 61 of coversheet supplying device 60.

<Square Spine Forming Device 80>

Square spine forming device 80 has conveyance rollers 81 and 82 to receive, convey and stop coversheet K supplied form coversheet supplying device 60 at a predetermined position, pressing member 83 to press coversheet K onto the adhesive agent applying surface of sheet bundle Sa, moving housing 84 to support conveyance rollers 81 and 82, and pressing member 83, aligning device 85, and hoisting device 86 which enables moving housing 84 to move vertical directions up and down.

Square spine forming device 80 and booklet ejection belt 88 go up and down integrally by hoisting device 86.

When square spine forming device 80 stops at a descent position and takes in coversheet K, aligning device 85 moves from an initial position in accordance with the size of coversheet K to press and align coversheet K at both side edges in width direction before cutting. After skew of coversheet K is corrected by aligning coversheet K in width, coversheet K switchbacks in an opposite direction to a direction of taking in, and is conveyed to coversheet cutting device 70 and is cut at a predetermined position.

Also, before square spine forming device 80 joints coversheet K after being cut, with the spine of sheet bundle Sa at the descent position, aligning device 85 again moves from the initial position and presses the both side edges of sheet K in width direction to align and then places coversheet S at a predetermined position.

Therefore aligning device 85 disposed on square spine forming device 80 capable of going up and down can achieve an improvement of coversheet cutting accuracy, an improvement of positioning accuracy of sheet bundle Sa with coversheet K and simplifying of a structure by coversheet cutting device 70 to align sheet bundle Sa with coversheet K in width direction of the coversheet before and after cutting coversheet K.

Hoisting device 86 moves moving housing 84 to upper position by rotating right and left belts. In this ascent position, a center section of coversheet K placed on pressing member 83 is pressed and bonded to the adhesive agent applying surface of sheet bundle Sa. Adhesive applying device 50 moves backward to be retracted after applying process of the adhesive agent to sheet bundle Sa.

<Coversheet Folding Process>

In an upper portion of square spine forming device 80, a coversheet folding device is provided. The coversheet folding device has a pair of symmetrical forming members 87A and 87B. Forming members 87A and 87B can be attached to and detached from sheet bundle Sa in a direction of the thickness of sheet bundle Sa. Forming members 87A and 87B fold coversheet K along side hems of the adhesive agent applying surface and lap a front and back surface of sheet bundle Sa by a front coversheet and back coversheet.

After completing a folding process of coversheet K, square spine forming deice 80 descends a predetermined distance by descending drive of hoisting device 86 to be retracted, and stops. Thereafter, when grasping by the grasping device is released, booklet Sb falls and the back of the bottom surface of booklet Sb comes in contact with an upper surface of booklet ejection belt 88, then booklet Sb is loaded on it to be ejected.

Figure 7:
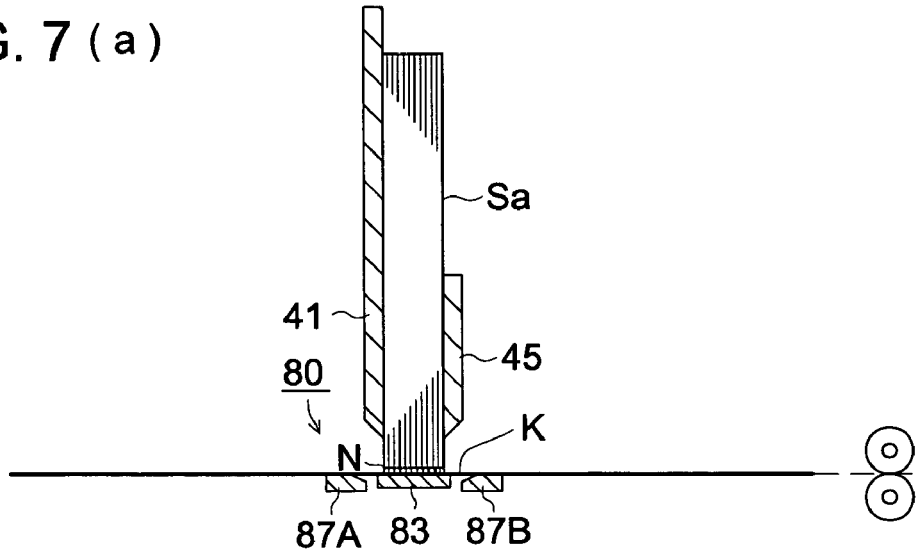
FIG. 7 (*a*) is a cross-sectional view of a square spine forming device and a sheet bundle showing a folding process of a coversheet.
Figure 7:
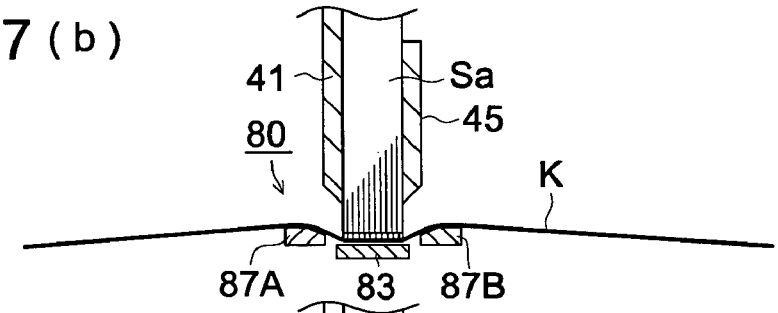
Figure 7:
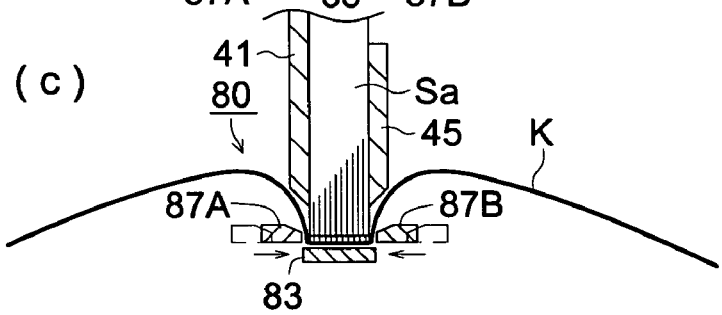
Figure 7:
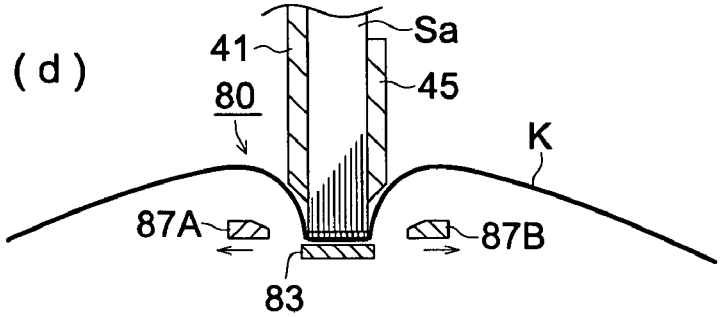

FIG. 7 is a cross-sectional view of square spine forming device 80 and sheet bundle Sa, showing folding process of coversheet K. FIG. 7 (*a*) shows a stage of starting coversheet folding, FIG. 7 (*b*) shows a stage in the middle of coversheet folding, FIG. 7(*c*) shows a stage of completing coversheet folding, and FIG. 7 (*d*) shows a stage where the coversheet folding pressure is released.

Figure 8:
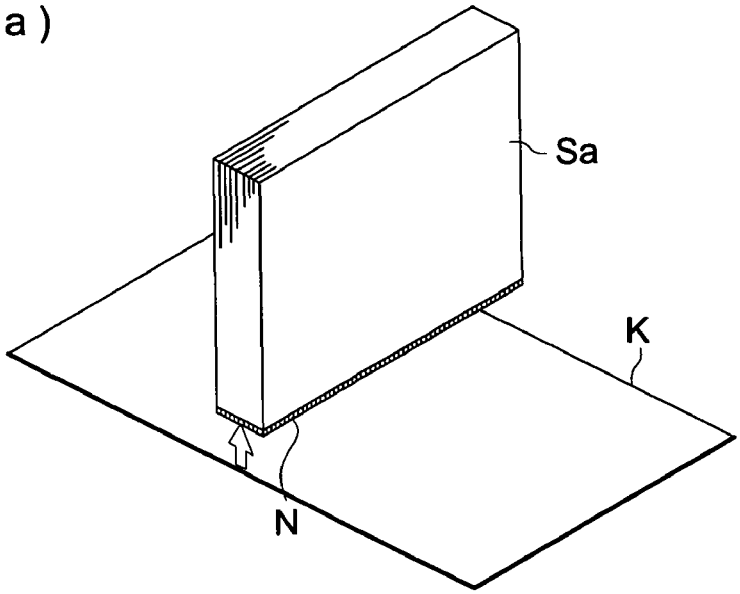
FIG. 8 (*a*) is perspective view showing a process of making a booklet by sheet bundle and a coversheet.
Figure 8:
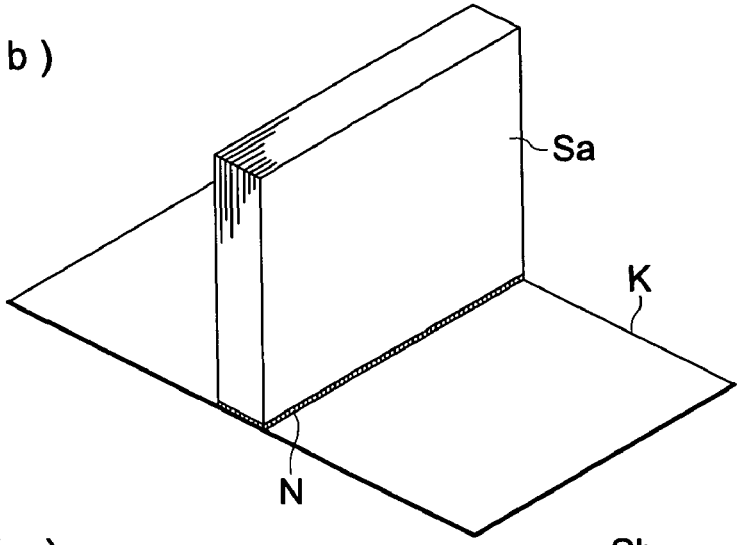
Figure 8:
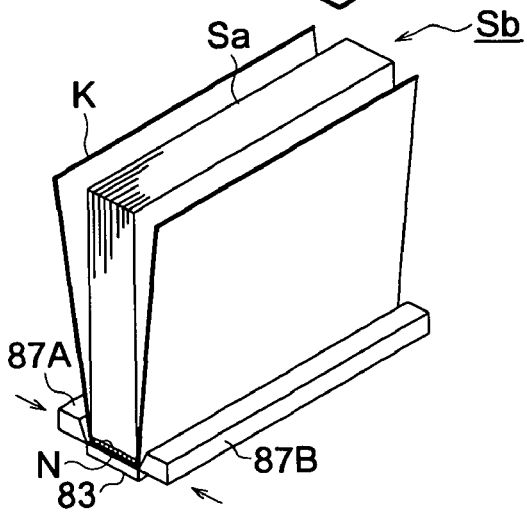

FIG. 8 is a perspective view of a process of forming booklet Sb with sheet bundle Sa and coversheet K. FIG. 8(*a*) is a perspective view of coversheet K and sheet bundle Sa in a status before coversheet gluing process, FIG. 8(*b*) is a perspective view of sheet bundle Sa to which coversheet K is affixed and FIG. 8(*c*) is a perspective view of booklet Sb formed through a process in which sheet bundle Sa is lapped with coversheet K by casing-in folding.

After coversheet K is bonded on sheet bundle Sa where adhesive agent N is applied, forming members 87A and 87*b* are driven by an unillustrated driving device in a status where square spine forming device 80 is elevated shown by FIG. 8.

Thereafter, forming members 87A and 87B move in a horizontal direction toward the adhesive agent applying surface side of sheet bundle Sa and press the both side surfaces of sheet bundle Sa to trim, then form booklet Sb.

As FIG. 1 shows, booklet Sb falls when grasping is released by opening pressing member 45 and is loaded on booklet ejection best 88 to be ejected in a direction of booklet ejection outlet 89, and then ejected to booklet storing device C outside the apparatus.

Ejected booklet Sb is loaded on conveyance belt 91 of booklet storing device C, which can goes up and down and is ejected sequentially by rotation of conveyance belt 91, then placed and stored on ejected sheet table 92.

<Driving Device for Square Spine Forming Device 80>

Figure 9:
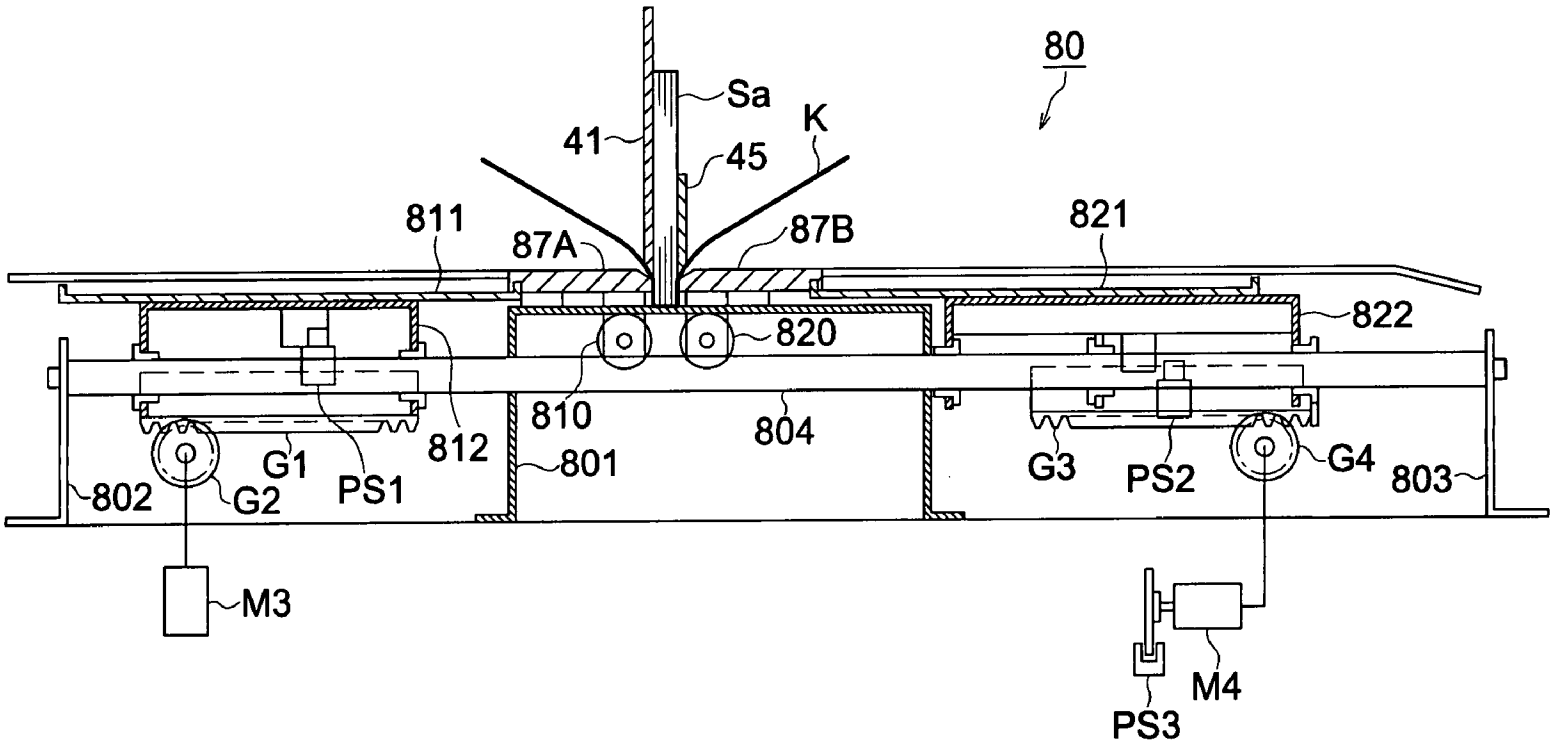
FIG. 9 is a cross-sectional view showing a driving device of the square spine forming device.

FIG. 9 is a cross-sectional view showing a driving device for square spine forming device 80.

Square spine forming device 80 brings coversheet K in contact with the back section of sheet bundle Sa where adhesive agent N is applied to bond them and folds coversheet K through a pair of forming member 87A and 87B to form the square spine.

Roller 810 is rotatably supported at a lower section near an end section of forming member 87A which is disposed on the left of sheet bundle Sa in the figure. Roller 810 in contact with a planar section of supporting member 801 which is fixed on an main body of bookbinding apparatus B, is able to move in a horizontal direction.

Connecting plate 811 fixed near a rear end section of forming member 87A is connected with moving frame body 812. Moving frame body 812 is able to slide through a bearing along guide bar 804 horizontally supported by supporting members 802 and 803 fixed on a main body of bookbinding apparatus B.

A rack gear G1 is formed on a bottom section of moving frame body 812. Rack gear G1 engages with pinion gear G2 supported by the main body of bookbinding apparatus B. Pinion gear G2 is rotated by motor M3 to move rack gear G1 in a horizontal direction and to move moving frame body 812 which is integral with rack gear G1, connecting plate 811, and forming member 87A. Sensor PS1 detects an amount of moving of moving frame body 812.

Roller 820 is rotatably supported at a lower section near an end section of forming member 87B, which is disposed on the right of sheet bundle Sa shown by the figure. Roller 820 is in contact with a planar section of supporting member 801, which is fixed on a main body of bookbinding apparatus B and able to move in a horizontal direction.

Connecting plate 821 fixed near a rear end section of forming member 87B is connected with moving frame body 822. Moving frame body 822 is able to slide along guide bar 804 through a bearing.

A rack gear G3 is formed on a bottom section of moving frame body 822. Rack gear G3 engages with pinion gear G4 supported by a main body of bookbinding apparatus B. Pinion gear G4 is rotated by motor M4 to move rack gear G3 in horizontal direction and to move moving frame body 822 which is integral with rack gear G3, connecting plate 821, and forming member 87B. Sensor PS2 detects an amount of movement of moving frame body 822.

<Detection Device for Sheet Bundle Thickness>

Figure 10:
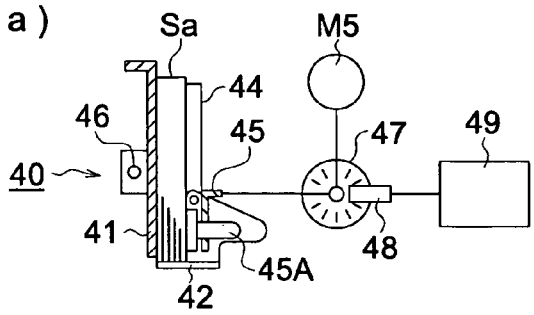
FIG. 10 (*a*) is a cross-sectional view of sheet storing device 40 with a detecting device for a sheet thickness showing a status where a bottom section of the sheet bundle is supported by retaining plate 42.
Figure 10:
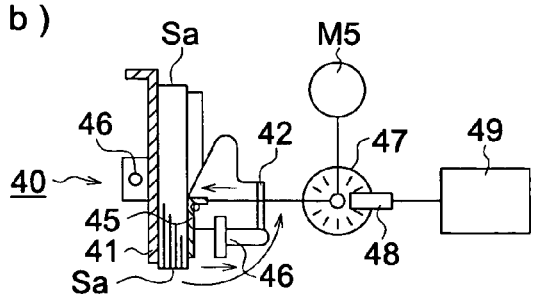

FIG. 10(*a*) and FIG. 10(*b*) are cross-sectional views of sheet storing device 40 and a detecting device for a sheet bundle thickness. FIG. 10(*a*) shows a status where a bottom section of sheet bundle Sa is supported by retaining plate 42, and FIG. 10(*b*) is a status wherein retaining plate 42 is being retracted before applying the adhesive agent.

Sheet S sequentially ejected from sheet reversal device 30 are accumulated in sheet bundle storing device 40 and sheet bundle Sa are formed. At a stage where a predetermined number of sheet S are accumulated, pressing member 45A operates to grasp sheet bundle Sa with supporting member 41 and pressing member 45.

Symbol 45A represents an pressing member to hold down sheet lifting of sheet bundle Sa to be accumulated. It moves left and right direction in the figure to hold in a thickness direction of sheet bundle Sa.

Sheet bundle Sa is firmly grasped between supporting member 41 which is stationary at a predetermined position and pressing member 45 which is moved by drive of motor M5 to press sheet bundle Sa and stops by detecting an increase of driving torque due to pressing. A stop position of pressing member 45 is detected through encoder 47 and sensor 48, and recorded in a memory device of position detecting device 49.

At a stage in which sheet bundle Sa is grasped by supporting member 41 and pressing member 45, an unillustrated motor and a driving device rotate retaining plate 42 90° by to retracted it as FIG. 10 (*b*) shows. Sheet S sequentially ejected from sheet reversal device 30 is accumulated in sheet, bundle storing device 40 so that sheet bundle Sa is formed. At a stage where a predetermined number of sheet S are accumulated, pressing member 45A is retracted and sheet bundle Sa is grasped by supporting member 41 and pressing member 45. In this status where sheet bundle Sa is held in a vertical condition, the adhesive agent is applied to the bottom surface of sheet bundle Sa by adhesive agent applying roller 51.

<Pressing Force Controlling Device>

Figure 11:
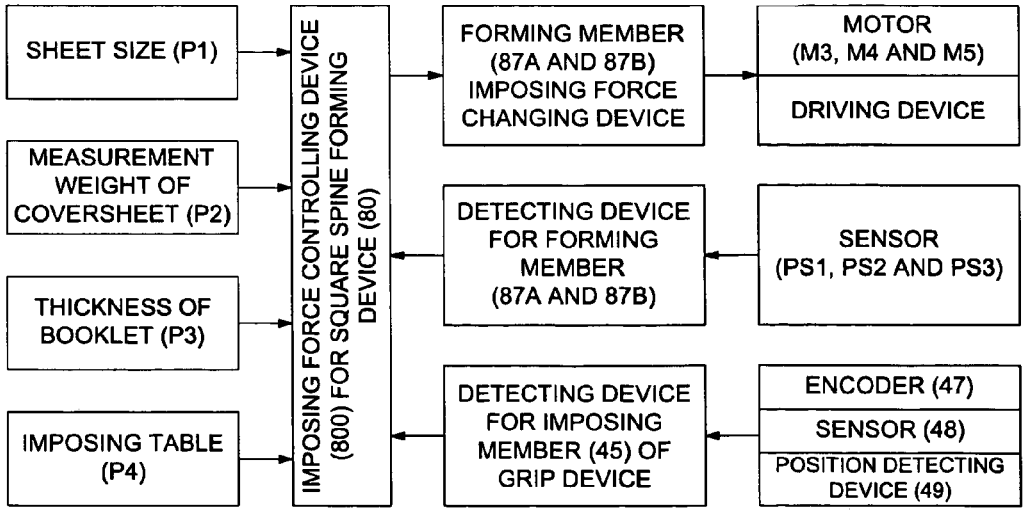
FIG. 11 is a block diagram of a pressure force controlling device.

FIG. 11 is a block diagram of pressing force controlling device.

A pressing force of pressing member 45 of square spine forming device 80 to press a bending section of coversheet K is controlled to be variable through a pressing force controlling device 800 in accordance with a condition of bookbinding.

Pressing force controlling device 800 having pressing force table P4 which includes any one of items such as sheet size P1 of booklet Sb to be bound, basis weight P2 of coversheet K or thickness P3 of booklet Sb, or some of the items thereof as parameters, selects a pressing force appropriate for conditions of booklet binding from pressing force table P4 and determine the pressing force to form the square spine.

TABLE 1

| Thickness of booklet (P3) 5 to 10 mm | | Basis weight of coversheet (P2) 80 to 110 g | 111 to 130 g | 131 to 160 g |
|---|---|---|---|---|
| Size of sheet (P1) | A4 sheet | 19 kg | 20 kg | 21 kg |
| | B5 sheet | 17 kg | 18 kg | 19 kg |
| | A5 sheet | 16 kg | 17 kg | 18 kg |

Table 1 is pressure force table P4 indicating pressure force incase the square spine is formed on a booklet Sa composed of a small number of sheets where thickness P3 of booklet Sb is 5 to 10 mm.

TABLE 2

| Thickness of booklet (P3) 10 to 20 mm | | Basis weight of coversheet (P2) 80 to 110 g | 111 to 130 g | 131 to 160 g |
|---|---|---|---|---|
| Size of sheet (P1) | A4 sheet | 20 kg | 21 kg | 22 kg |
| | B5 sheet | 18 kg | 19 kg | 20 kg |
| | A5 sheet | 17 kg | 18 kg | 19 kg |

Table 2 is pressure force table P4 indicating pressure force incase the square spine is formed on a booklet Sa composed of a small number of sheets where thickness P3 of booklet Sb is 10 to 20 mm.

TABLE 3

| Thickness of booklet (P3) 20 to 30 mm | | Basis weight of coversheet (P2) 80 to 110 g | 111 to 130 g | 131 to 160 g |
|---|---|---|---|---|
| Size of sheet (P1) | A4 sheet | 21 kg | 22 kg | 23 kg |
| | B5 sheet | 19 kg | 20 kg | 21 kg |
| | A5 sheet | 18 kg | 19 kg | 20 kg |

Table 3 is pressure force table P4 indicating pressure force incase the square spine is formed on a booklet Sa composed of a small number of sheets where thickness P3 of booklet Sb is 20 to 30 mm.

Meanwhile, the pressure force in table P4 is study examples where strength of the booklet and appearance of the square spine are considered.

Assigned values inputted through operation device 9 of image forming apparatus main body A connected to bookbinding apparatus B or inputted through external apparatuses connected to image forming apparatus main body A are used for sheet size P1 of booklet Sb and basis weight P2 of coversheet K.

Pressure force controlling device 800 controls the pressure force of square spine forming device 80 so that the pressure force increases as sheet size P1 increases.

Pressure force controlling device 800 controls the pressure force of square spine forming device 80 so that the pressure force increases as basis weight P2 increases.

Pressure force controlling device 800 controls the pressure force of square spine forming device 80 so that the pressure force increases as thickness P3 of booklet Sb increases.

Measurement values through encoder 47 to detect moving amount of pressing member 45 of grasping device to grasp sheet bundle Sa, sensor 48 and position detecting device 49 are used as thickness P3 of booklet Sb. Or a theoretical values obtained from an average thickness of a piece of sheet predetermined by a sheet basis weight and number of sheets forming booklet Sb can be used as the thickness of booklet Sa.

In this way, by selecting and determining the pressure force of square spine forming device 810 appropriate for the conditions of bookbinding from pressure force table P4 to form the square spine, the appearance and the strength can be improved.

In the present embodiment, while the device having a structure where adhesive agent is applied on the spine of the sheet bundle has been described, it is not to be understood that devices are limited to the embodiment thereof, and a device wherein the adhesive agent is applied coversheet side is possible. Also, the device is not limited to the one having the pressure force table, a device in which an appropriate pressure force is determined from one of aforesaid parameters or a plurality of the parameters is possible. In this regard, by having a predetermined table, the more appropriate pressure force can be determined easily. Further, image forming apparatus A is not limited to an electrophotographic apparatus and can be various types of image forming apparatuses such as inkjet type.

(1) According to the bookbinding apparatus of the present embodiment, by varying the pressure force of forming member to grasp the square spine section of the sheet bundle in accordance with the conditions of booklet binding, the quality of appearance is improved and a bookbinding apparatus, which can maintain the strength of the booklet can be provided.

(2) Also, according to the bookbinding apparatus of the present embodiment, a bookbinding apparatus connected with an image forming apparatus realizes that one system can carry out a job from printing to binding in one sequential flow so that a booklet having a high appearance quality and high booklet strength is formed efficiently.

What is claimed is:

1. A bookbinding apparatus, comprising:

a sheet bundle storing device to store a sheet bundle;

a grasping device to grasp the sheet bundle stored in the sheet bundle storing device;

a square spine forming device to form a square spine, wherein a pair of forming members bend a coversheet bonded onto a back section of the sheet bundle grasped by the grasping device;

a pressure force table including a basis weight of the coversheet as a parameter;

an operation device for inputting the basis weight of the coversheet; and a pressure force controlling device to control the square spine forming device according to the basis weight of the coversheet with reference to the pressure force table, so as to fold the coversheet bonded onto the sheet bundle with an appropriate pressure force so that an appropriate adhesion force between the coversheet and the sheet bundle, and a superior quality of appearance of a booklet are obtained, wherein the pressure force controlling device varies the pressure force so as to increase the pressure force as the basis weight of the coversheet increases.

2. The bookbinding apparatus of claim 1, wherein the pressure force table used by the pressure force controlling device to vary the pressure force in accordance with the bookbinding conditions includes the basis weight of the coversheet and at least one of a sheet size of the sheet bundle and a thickness of the sheet bundle.

3. The bookbinding apparatus of claim 1, wherein the pressure force table used by the pressure force controlling device to vary the pressure force in accordance with bookbinding conditions includes a sheet size of the sheet bundle, the basis weight of the coversheet, and a thickness of the sheet bundle.

4. The bookbinding apparatus of claim 1, further comprising a communication device configured to receive a sheet size of the sheet bundle and the basis weight of the coversheet from an image forming apparatus main body connected with the bookbinding apparatus.

5. The bookbinding apparatus of claim 1, wherein a measurement value, which is obtained by detecting a moving amount of the grasping device to grasp the sheet bundle, is used as a thickness of the sheet bundle.

6. The bookbinding apparatus of claim 1, wherein the pressure force controlling device varies the pressure force so as to increase the pressure force as a sheet size of the sheet bundle increases.

7. The bookbinding apparatus of claim 1, wherein the pressure force controlling device varies the pressure force so as to increase the pressure force as a thickness of the sheet bundle increases.

8. The bookbinding apparatus of claim 1, wherein the bookbinding apparatus is a case-in bookbinding apparatus to form a booklet wherein the coversheet is bonded on the back section of the sheet bundle to form the square spine.

9. An image forming system, comprising;

an image forming apparatus to form an image on a recording sheet based on data of a manuscript; and a bookbinding apparatus, including:

a sheet bundle storing device to store a sheet bundle, a grasping device to grasp the sheet bundle stored in the sheet bundle storing device, a square spine forming device to form a square spine, wherein a pair of forming members bend a coversheet bonded onto a back section of the sheet bundle grasped by the grasping device, a pressure force table including a basis weight of the coversheet as a parameter, an operation device for inputting the basis weight of the coversheet, and a pressure force controlling device to control the square spine forming device according to the basis weight of the coversheet with reference to the pressure force table, so as to fold the coversheet bonded onto the sheet bundle with an appropriate pressure force so that an appropriate adhesion force between the coversheet and the sheet bundle, and a superior quality of appearance of a booklet are obtained, wherein the pressure force controlling device varies the pressure force so as to increase the pressure force as the basis weight of the coversheet increases.

10. A bookbinding apparatus, comprising:

a sheet bundle storing device configured to store a sheet bundle;

a grasping device configured to grasp the sheet bundle stored in the sheet bundle storing device;

a square spine forming device configured to form a square spine using at least two forming members configured to bend a coversheet bonded onto a back section of the sheet bundle grasped by the grasping device;

a pressure force table including a basis weight of the coversheet as a parameter;

an operation device for inputting the basis weight of the coversheet; and a pressure force controlling device to control the square spine forming device according to the basis weight of the coversheet with reference to the pressure force table, so as to fold the coversheet bonded onto the sheet bundle with an appropriate pressure force so that an appropriate adhesion force between the coversheet and the sheet bundle, and a superior quality of appearance of a booklet are obtained, wherein the pressure force controlling device varies the pressure force so as to increase the pressure force as the basis weight of the coversheet increases.

11. The bookbinding apparatus of claim 10, wherein the varying of the pressure force is based on a sheet size of the sheet bundle, and the pressure force controlling device is configured to increase the pressure force as the sheet size of the sheet bundle increases.

12. The bookbinding apparatus of claim 10, wherein the varying of the pressure force is based on a thickness of the sheet bundle, and the pressure force controlling device is configured to increase the pressure force as the thickness of the sheet bundle increases.

13. The bookbinding apparatus of claim 10, wherein the pressure force controlling device is configured to increase the pressure force as the thickness of the sheet bundle increases by using a plurality of pressure force tables each corresponding to a different range of thickness of the sheet bundle.

14. The bookbinding apparatus of claim 10, wherein the pressure force controlling device is configured to vary the pressure force of the at least two forming members based at least on the sheet size of the sheet bundle, the basis weight of the coversheet, and the thickness of the sheet bundle.

* * * * *